US007232048B2

(12) United States Patent
Le Gal et al.

(10) Patent No.: US 7,232,048 B2
(45) **Date of Patent: *Jun. 19, 2007**

(54) DEVICE FOR CARRYING A LOAD ON ONE'S BACK AND FOR ADJUSTING THE POSITION OF SAID LOAD

(75) Inventors: Yann Le Gal, Biviers (FR); Matthieu Froidevaux, Parigny (FR)

(73) Assignee: Lafuma SA, Anneyron (FR)

( * ) Notice: Subject to any disclaimer, the term of this patent is extended or adjusted under 35 U.S.C. 154(b) by 567 days.

This patent is subject to a terminal disclaimer.

(21) Appl. No.: 10/776,969

(22) Filed: Feb. 11, 2004

(65) Prior Publication Data

US 2004/0178238 A1 Sep. 16, 2004

(30) Foreign Application Priority Data

Mar. 12, 2003 (FR) ..... 03 03040

(51) Int. Cl.
*A45F 3/04* (2006.01)
*A45F 3/08* (2006.01)
*A45F 3/10* (2006.01)

(52) U.S. Cl. ..... 224/201; 224/631; 224/632; 224/634

(58) Field of Classification Search ..... 224/201, 224/265, 631, 632, 634, 637
See application file for complete search history.

(56) References Cited

U.S. PATENT DOCUMENTS 3,799,414 A * 3/1974 Fiffer ..... 224/161
4,013,201 A 3/1977 Potter ..... 224/25
5,284,279 A 2/1994 Sason et al. ..... 224/209
5,971,244 A * 10/1999 Jaeger ..... 224/632
6,179,188 B1 * 1/2001 Gleason ..... 224/641

FOREIGN PATENT DOCUMENTS

FR 2677235 12/1992
FR 2776169 12/1999

* cited by examiner

*Primary Examiner*—Nathan J. Newhouse
*Assistant Examiner*—Jack Morgan
(74) *Attorney, Agent, or Firm*—Heslin Rothenberg Farley & Mesiti P.C.

(57) ABSTRACT

This device is noteworthy in that it comprises two elements of positional control and adjustment made using manual remote controls that are independent of one another and that allow the position of a back frame to be adjusted with respect to a carrying harness. The first element allows the back frame to be raised with respect to the harness and the second element allows the back frame to be lowered with respect to the harness. The back frame is designed to receive an endless belt arranged in its median longitudinal plane. The belt is secured by a strand to the carrying harness allowing the back frame to move relative to the harness via the positional control and adjustment elements. A locking mechanism tensioned by the second control element acts and locks the endless belt in position or releases it according to the desired phases of movement. The second control element includes a strap, one end of which is secured to the endless belt and to the harness and the other end of which is designed to form a control handle. The strap passes over, bears on and actuates the locking mechanism.

15 Claims, 4 Drawing Sheets

Figure 1:
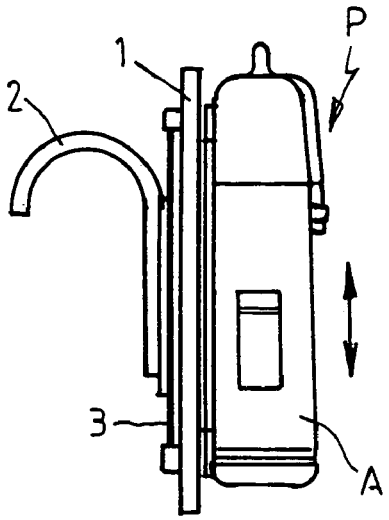

FIG.12
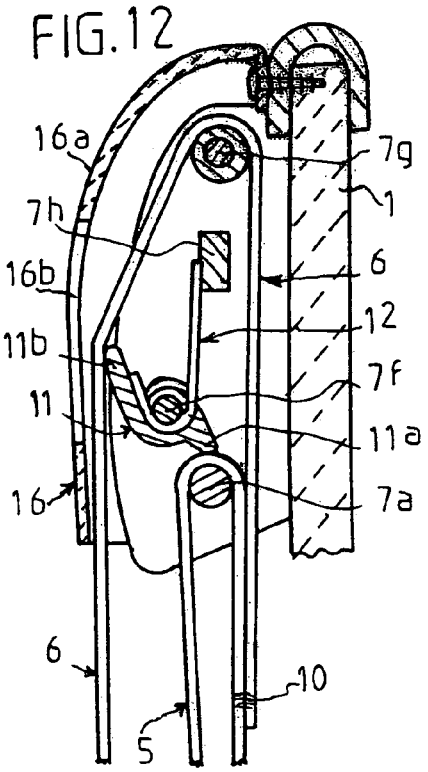
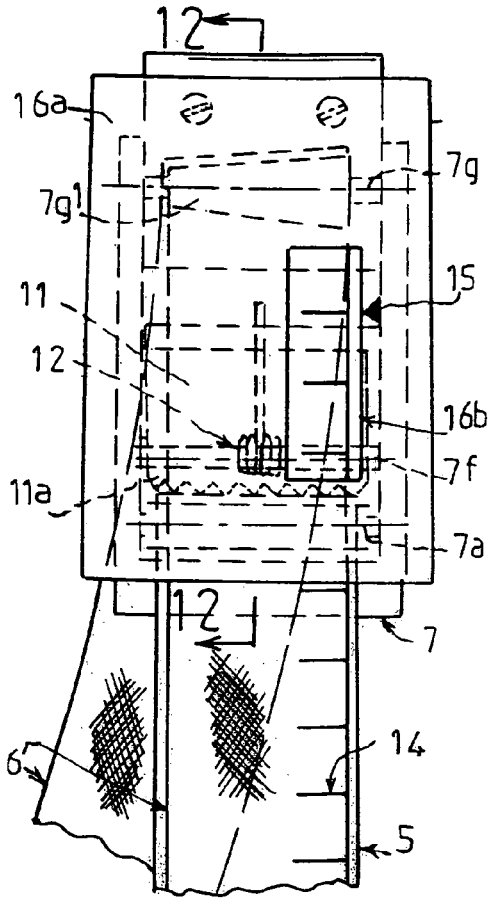
FIG.11
FIG.13
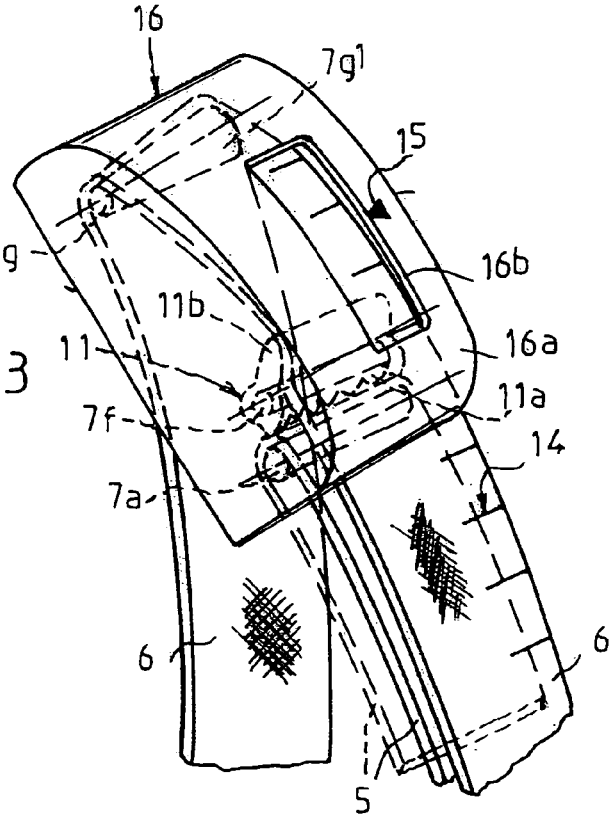

DEVICE FOR CARRYING A LOAD ON ONE'S BACK AND FOR ADJUSTING THE POSITION OF SAID LOAD

The invention relates to the technical field of travel luggage, backpacks for outdoor pursuits and schoolbags for carrying and transporting loads of any kind, as well as that of baby carriers, and, in general, any equipment, for carrying a load on one's back, having a harness that fits on the wearer.

For some backpack applications, devices have been proposed for the positional adjustment of the bag part, which is loaded to some degree, with respect to a bag back part that is associated with a carrying harness and can be adjusted selectively prior to carrying, or adjusted remotely using a remote control system. The equipment proposed is not very practical, difficult to implement and costly to manufacture.

As far as the applicant is aware, as regards the transport of travel luggage, there is no possibility of positional adjustment of the load to ensure comfort for the user. Travel luggage that incorporates wheels facilitating transport and a retractable gripping handle is becoming increasingly popular. Luggage of this type sometimes has shoulder straps. In cases where passage is difficult, travelers can thus lift the luggage and carry it. There is no possibility of positional adjustment as a function of the load.

The situation is the same in the case of schoolbags, and also baby carriers.

The applicant therefore decided to consider a new design of device for carrying a load on one's back and for adjusting the position of said load that could be used for travel luggage, backpacks for outdoor pursuits, schoolbags, baby carriers, and, in general, any equipment allowing an individual to carry a load on his back.

Thus, the applicant's research and studies have resulted in a device that can solve the problem posed for all potential uses as described above.

Thus, according to the invention, the device requires the use of a common design that can then be secured to each type of luggage or load support.

According to a first feature, the device for carrying a load on one's back and for adjusting the position of said load, of the type comprising a back frame on which is positioned a carrying harness, is noteworthy in that it comprises two means of positional control and adjustment, made using manual remote controls, that are independent of one another and that allow the position of the back frame to be adjusted with respect to the carrying harness, the first means allowing the back frame to be raised with respect to the harness and the second means allowing the back frame to be lowered with respect to the harness, and in that the back frame is designed to receive an endless belt arranged in its median longitudinal plane, said belt being secured by a strand to the carrying harness and allowing the back frame to move relative to the harness via the positional control and adjustment means, and in that a locking mechanism tensioned by the second control means acts and locks the endless belt in position or releases it according to the desired phases of movement, and in that said control means includes a strap, one end of which is secured to the connecting belt and to the harness and the other end of which is designed to form the control handle, said strap passing over the locking mechanism, bearing on the latter and actuating it.

These features and others besides will become clearly apparent from the remainder of the description.

Figure 2:
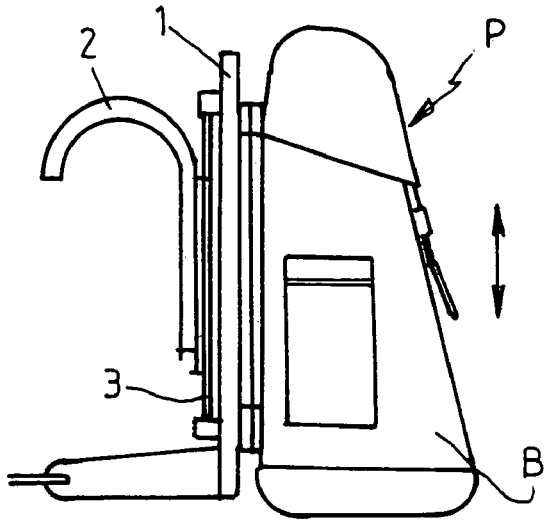
Figure 3:
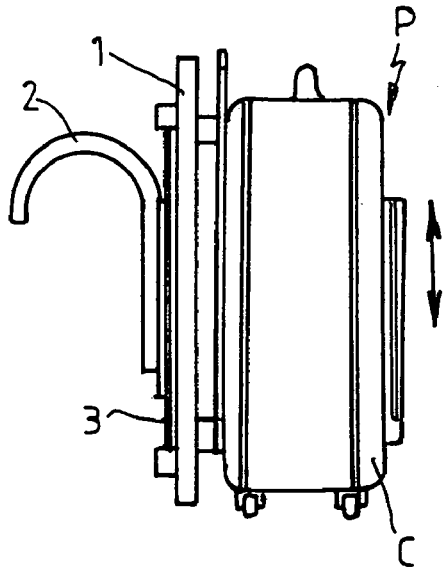
Figure 4:
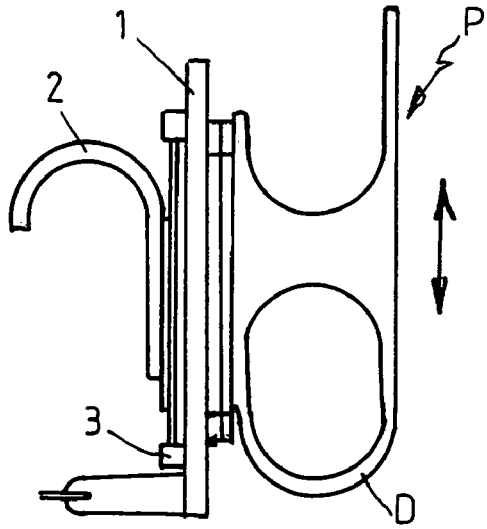
Figure 5:
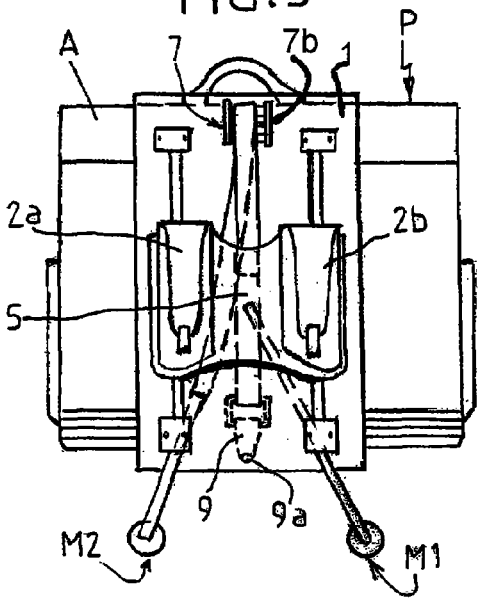
Figure 6:
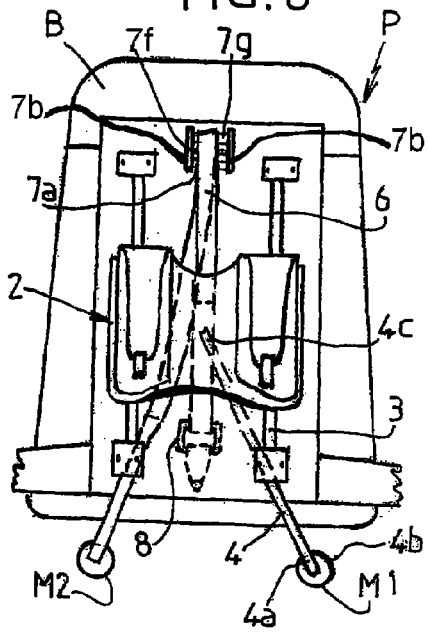
Figure 7:
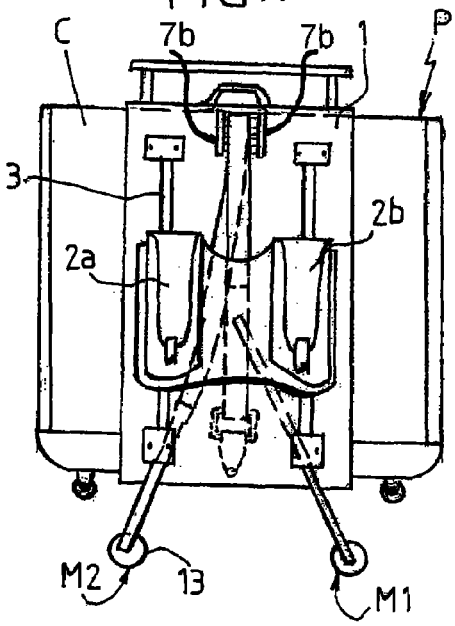
Figure 8:
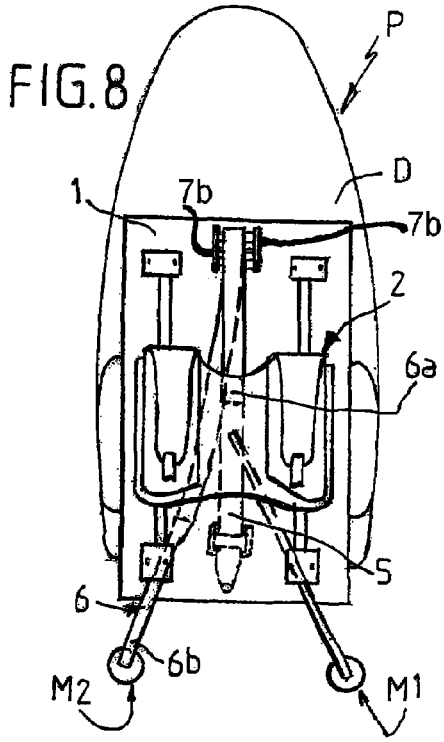
Figure 10:
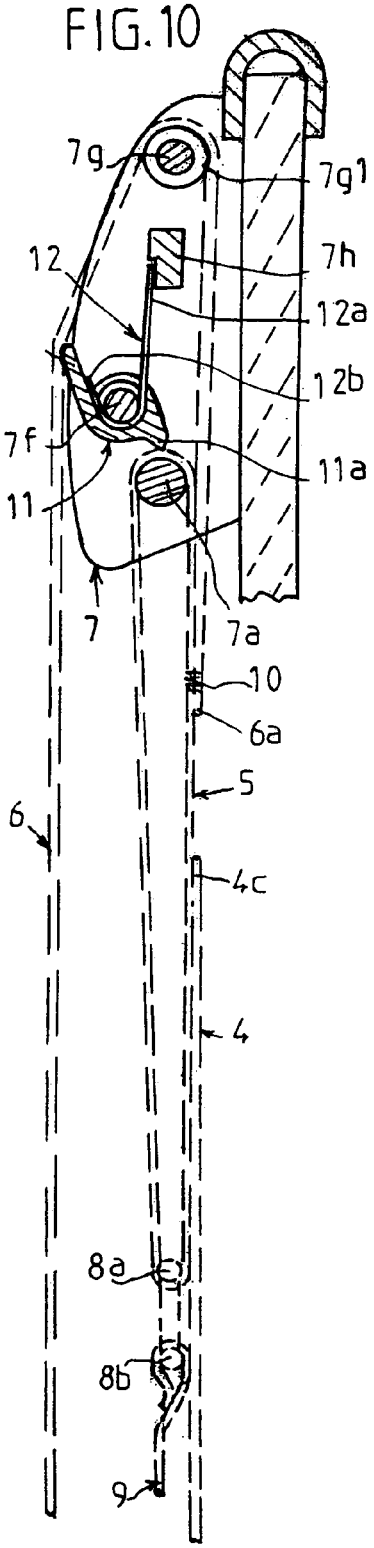
Figure 9:
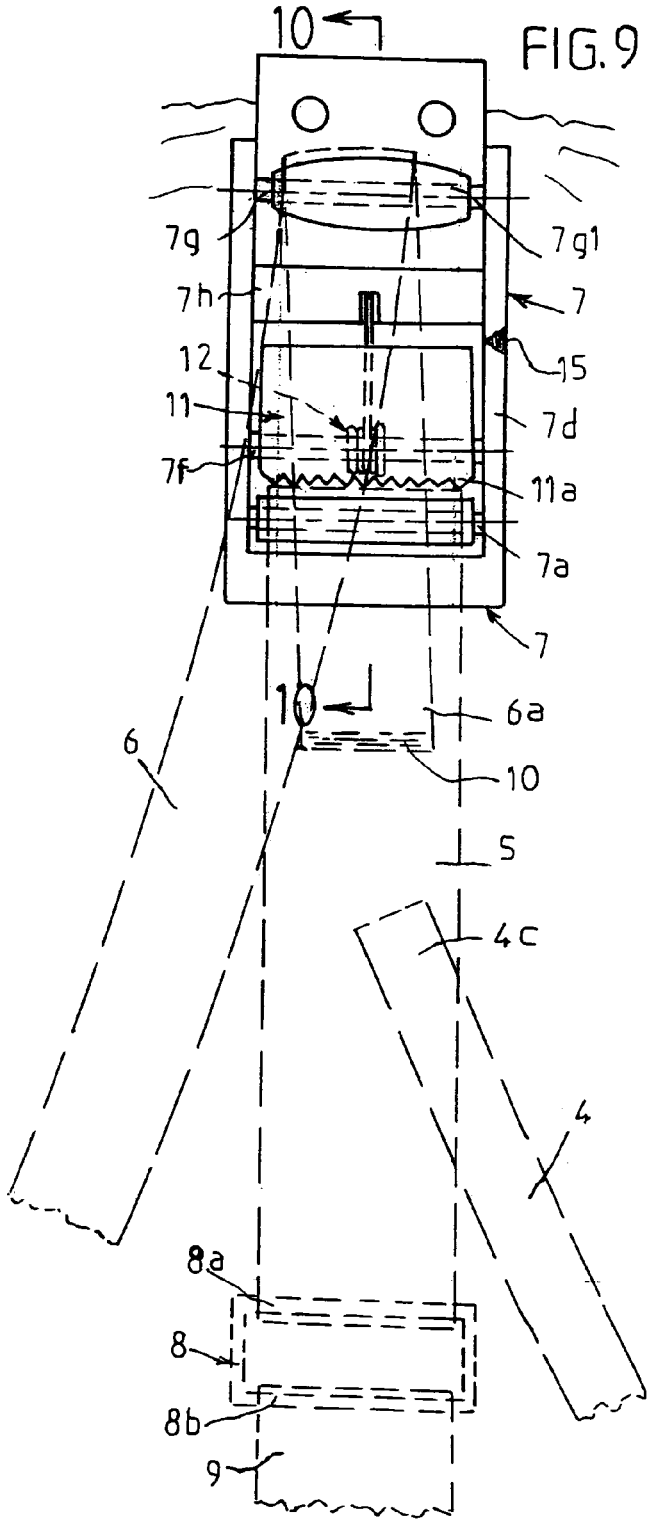

The object of the invention is illustrated, without restrictive intent, in the figures of the drawings, in which:

FIG. 1 is a diagrammatic view showing the device for carrying a load on one's back according to the invention in a first application to a satchel-type schoolbag, FIG. 2 is a view, according to FIG. 1, in the application of the device to a backpack for outdoor pursuits, FIG. 3 is a view, according to FIG. 1, in the application of the device to travel luggage of the wheeled-suitcase type, FIG. 4 is a view, according to FIG. 1, in the application of the device to a baby carrier, FIGS. 5 to 8 are rear views illustrating each item of carrying equipment defined in FIGS. 1 to 4 implementing the invention, FIG. 9 is a partial front view illustrating the device of the invention, in a first embodiment, FIG. 10 is a view in section, along line 10.10 of FIG. 9, FIG. 11 is a partial front view illustrating the device of the invention in a variant embodiment, FIG. 12 is a view in section, along line 12.12 of FIG. 11, FIG. 13 is a partial perspective view illustrating the use of the protective cover for positional control of the adjusting device.

In order to give a more concrete idea of the subject of the invention, it will now be described in a non-limiting manner illustrated by the figures of the drawings.

In the remainder of the description, the device for carrying a load on one's back and for adjusting the position of said load will be described in principle with reference to FIGS. 9 to 13. To identify the back-carrying applications given by way of non-limiting example and illustrated in FIGS. 1 to 8, (A) depicts a schoolbag, for example of the satchel type, (B) depicts a backpack for outdoor pursuits, for example of the knapsack type, (C) depicts travel luggage, of the wheeled-suitcase type, and (D) depicts a baby carrier for outdoor pursuits. In the remainder of the description, the generic term Product (P) will be used to refer to the abovementioned applications. The device for carrying a load on one's back of the invention requires that the product have a shaped back frame (1), secured in any appropriate manner to the Product, by sewing or otherwise. The back frame (1) is thus designed to cooperate, on one side, with the device of the invention and, on the other, with the Product part. The back frame (1) is made with a rigid covering material or in the form of a thermoformed shell covered with a textile outer covering.

As is known, the Product back frame can receive, on its side facing the wearer, a carrying harness (2) with shoulder straps (2*a*–2*b*) allowing a load to be carried. The adjustment of the position of the harness with respect to the Product back frame, which is known per se, can be performed along tubular slideways (3) or other profiles placed along the back frame, the harness having loops for moving up and down said slideways.

The invention relates to a particular device allowing the positional adjustment of the back frame associated with the Product with respect to the carrying harness, and thus the design of the back frame/harness assembly that ensures this function. Said adjustment must thus be performed in two movements of displacement of the Product back frame with respect to the carrying harness, the latter being in a fixed position on the wearer.

According to the invention, the device for adjusting the bag back part with respect to the carrying harness comprises a first means (M1) of adjustment made using a remote control that is manually tensioned by the operator himself. This first means is essentially for raising the back frame associated with the Product with respect to the harness.

It comprises a non-elastic pulling means (4), a first free end (4*a*) of which is located on the lower part of the back frame associated with the Product, said end being designed to form a gripping and pulling means in the shape of a loop, handle or the like (4*b*). The other end (4*c*) is fixed directly or indirectly to the harness (2).

It will thus be understood that if the wearer pulls manually on the gripping end (4*b*) of the means (4), this will entrain the means and thus bring the lower part of the back frame closer to the lower part of the harness, thus raising the back frame associated with the Product.

The device of the invention also comprises a means (M2) for lowering the back frame with respect to the harness and thus fine-tuning the positional adjustment of one with respect to the other.

More specifically, said means (M2), as a whole, comprises a means (5) for connection between the harness (2) and the back frame (2) allowing one to be moved with respect to the other into a maximum raised position or maximum lowered position, or intermediate positions, and a second control means (6) for the desired positional adjustments.

The connecting means (5) is in the form of an endless belt made of any appropriate material, this belt being located in the median longitudinal axis of the back frame. This belt is kept tensioned but is free to roll and is positioned with respect to a first return means (7) fixedly located on the upper part of the back frame and to a second return means (8) fixedly located on the lower part of the back frame.

The lower part of said belt (5) passes around a pin (8*a*) of a buckle fastening, whereas around the second pin (8*b*) of said fastening there passes a loop (9) whose lower end (9*a*) is secured in an appropriate manner to the lower part of the back frame.

The connecting endless belt (5) is kept tensioned at the top over the pin (7*a*) of the upper return means (7) that is located between the wings (7*b*) of said means.

The endless belt is arranged on a single side of the back frame. Said endless belt is secured, via one of its strands (7*c*), to the carrying harness (2) by one or more connection means (10). It will thus be understood that the movement of the harness with respect to the back frame is closely linked to the movement of said endless belt by an amplitude defined by the outer, upper and lower, parts of the harness with respect to the back frame. Said harness/endless belt connection is made by any appropriate means.

The return means (7) comprises a shell part (7*d*) with a pin (7*a*) over which the strand of the belt (5) passes. The base (7*e*) of the upper return means (7) is fastened to the back frame (1) by any appropriate means. The return means (7) includes an additional pin (7*f*) to which a locking mechanism (11) is articulated. The return means (7) includes an upper pin (7*g*) between the wings (7*b*) whose function will be explained later. The locking means (11) mounted so as to pivot on the pin (7*f*) is designed with a serrated profiled shape (11*a*) able to come into contact with and press on the facing part of the endless belt (5). The locking means (11) has an extension (11*b*) that makes a V angle with the serrated shape (11*a*), being in a plane that is offset externally with respect to the plane of said shape (11*a*). A return spring (12) of the hairpin type is mounted on the pin (7*f*) and one of its legs (12*a*) can bear on a bearing wall (7*h*) formed on the return means (7) and the other leg (12*b*) bears on the rear face of the extension (11*b*).

Furthermore, according to the invention, the control means (M2) includes a strap (6), one end (6*a*) of which is secured to the connecting belt (5) in an area (10) located at the point where said belt (5) is fastened to the harness (2). As can be seen in FIGS. 9 to 13, said strap (6) passes over the locking mechanism (11) and bears on the latter in particular on the extension part (11*b*) of the pivoting lever (11). The strap (6) passes around the upper pin (7*g*) so as to then be guided between the back frame and the rear strand of the connecting belt (5). The strap (6) has a free end strand (6*b*), in order to be coupled with the control handle of the means (M2) made in the form of a gripping tongue (13). The strap (6), thus designed, forms overall the control means (M2) for the relative positioning of the bag back frame and the harness.

In this embodiment, the upper return means (7) has a pin (7*g*) for the passage and return of the strap (6), said strap. (6) being oriented in an oblique position outside of the plane of the endless connection belt (5) so as to be pulled by the wearer. The pin (7*g*) has a domed or conical shape (7*g*1). Whether this shape is domed or conical depends on the width of the strap (6) and on the desired orientation given to the position of said strap. This allows the strap (6) to be oriented laterally by sliding and causes it to take up an oblique position.

In the case where the strap can be pulled in a direction to the right or left of the bag back part, said pin (7*g*) has a domed shape and the width of the strap (6) is about half the length of the pin (7*g*) so as to be positioned and slid alternately right and left, giving the desired orientation.

If the strap (6) is oriented obliquely only to one side, the pin (7*g*) is conical with a slope oriented in the direction of the side on which the strap is positioned. The strap may then be wider.

Reference should be made to the figures for the explanation of how the device of the invention can be used.

Actuating the control means (M1) tensions the means (4) and thus pulls the connecting belt (5) associated with the harness (2) to which is attached the end (4*c*) of the means (4). This causes the belt (5) to roll downward, in opposition to the locking means (11), which pivots in the direction of the arrow (F1), hand the bag back rises in the direction of the arrow (F2), the harness remaining in place on the user.

When the control means (M2) is pulled, this actuates the strap (6). Under the pulling force, the strap causes the lever (11) to pivot by bearing on its extension arm (11*b*), thus releasing the connecting belt (5). This allows the bag back part to move downward.

According to another feature of the invention, the latter includes a position-control and reading means allowing the wearer to memorize the relative positions of the back frame/harness that are most suitable according to the conditions of use.

According to a particular arrangement, the strap (6) has, over part of its length, substantially at the point where it passes through and around the return means (7), a graduated scale (14) with a predefined spacing, thus defining relative positions of the back frame with respect to the harness.

This graduated scale (14) is visible to the wearer and a reference index (15) can be made on the abovementioned return means (7), to form a benchmark.

However, in a specific embodiment (FIGS. 11 to 13), the upper return means (7) is designed to receive a cover (16) for protecting the locking mechanism (11) assembly. This protective cover (16) is fixed or articulated to the return means, and is made of any suitable material. On its front face (16*a*), it has a vertical window (16*b*) which can be opposite the strap (6) and in particular opposite its graduated scale. The cover then bears the reference index (15). The wearer can therefore easily see the graduated zone of the strap (6) and memorize the appropriate graduations corresponding to specific positions of the back frame with respect to the harness. This arrangement is practical, allowing rapid adjustment, particularly if the back frame is worn by several different people or if adjustment changes are necessary owing to poor handling. The graduated scale may be numerical, alphanumeric, or otherwise.

Thus, according to the invention, the wearer can adjust and optimize, micrometrically, the position of the back frame associated with the Product with respect to the carrying harness.

Fitting is easy to achieve and simple to implement. The proposed solution offers greater comfort for the wearer, who can immediately adjust the position of the Product at any time. Controlling the position of the back frame with respect to the harness also ensures comfort in use.

The invention applies to the abovementioned Product whose applications have been illustrated by way of non-limiting example.

The invention claimed is:

1. A device for carrying a load on one's back and for adjusting position of said load, of the type comprising a back frame on which is positioned a carrying harness, comprising first means and second means of positional control and adjustment, made using manual remote controls, that are independent of one another and that allow position of the back frame to be adjusted with respect to the carrying harness, the first means allowing the back frame to be raised with respect to the harness and the second means allowing the back frame to be lowered with respect to the harness, and in which the back frame is designed to receive an endless belt arranged in a median longitudinal plane, said belt being secured by a strand to the carrying harness and allowing the back frame to move relative to the harness via the first and second positional control and adjustment means, and in which a locking mechanism tensioned by the second means acts and locks the endless belt in position or releases it according to desired phases of movement, and in which said second means includes a strap, one end of which is secured to the endless belt and to the harness and an other end of which is designed to form a control handle, said strap passing over, bearing on and actuating the locking mechanism.

2. The device as claimed in claim 1, wherein the first means comprises a non-elastic pulling means, a first end of which is located on a lower part of the back frame with a gripping means the an other end being fixed to the harness.

3. The device as claimed in claim 1, wherein the strap has a free-end strand with an end for coupling with the control handle of the second means, being made in the form of a gripping tongue in elastomeric material.

4. The device as claimed in claim 1, applied to travel luggage.

5. The device as claimed in claim 1, applied to backpacks for outdoor pursuits.

6. The device as claimed in claim 1, applied to schoolbags.

7. The device as claimed in claim 1, applied to baby carriers.

8. The device as claimed in claim 1, wherein the endless belt is kept tensioned but is free to roll and is positioned with respect to a first, upper return means fixedly located on an upper part of a bag back part and to a second, lower return means fixedly located on a lower part of the back frame.

9. The device as claimed in claim 8, wherein the strap has, over part of its length, at a point where it passes through and around the first return means, a graduated scale defining, with respect to a reference index made using the first return means, relative positions of the bag back part and the harness.

10. The device as claimed in claim 9, wherein the first return means receives a cover for protecting the locking mechanism, and wherein a front face of the cover has a window opposite the strap and its graduated scale, the reference index being borne by the cover.

11. The device as claimed in claim 8, wherein the upper return means comprises a shell part with, between wings, a lower pin for holding the endless belt and an upper pin for returning the strap, and wherein, between the lower pin and the upper pin, there is a third pin around which is pivotably mounted the locking mechanism formed of a lever pivoting in opposition to an elastic return means, said lever being oriented such that it has a serrated profiled shape in contact with and pressing on a facing part of the endless belt, and an extension arm offsetting the strap when the mechanism is not tensioned.

12. The device as claimed in claim 11, wherein the other end of the strap is associated with a gripping and pulling tongue, said strap being arranged between the back frame and the strand of the endless belt.

13. The device as claimed in claim 11, wherein a lower end of the endless belt is mounted around a pin of a buckle fastening, said fastening including a second pin around which is wound a loop whose lower end is secured to the back frame.

14. The device as claimed in claim 11, wherein third return means of hairpin spring type is mounted on the third pin for articulation of the lever, and wherein one of legs of the third return means bears on a bearing wall formed by the upper return means and an other leg bears on a rear face of the extension arm.

15. The device as claimed in claim 11, wherein the strap return pin has a domed or conical shape allowing the strap to be oriented in an oblique position with respect to the endless belt, said strap having a width adapted to a profile of the pin.

* * * * *

UNITED STATES PATENT AND TRADEMARK OFFICE

CERTIFICATE OF CORRECTION

PATENT NO. : 7,232,048 B2
APPLICATION NO. : 10/776969
DATED : June 19, 2007
INVENTOR(S) : LeGal et al.

It is certified that error appears in the above-identified patent and that said Letters Patent is hereby corrected as shown below:

In The Claims:

Claim 2, Column 5, line 44, delete "Gripping means the an other end being fixed to the harness." and insert -- gripping means, an other end being fixed to the harness. --

Signed and Sealed this

Fourteenth Day of August, 2007

JON W. DUDAS
*Director of the United States Patent and Trademark Office*